United States Patent [19]

Hutchison

[11] 4,112,453

[45] Sep. 5, 1978

[54] ROTARY FILM PROCESSING APPARATUS

[75] Inventor: William Joseph Hutchison, Rochester, N.Y.

[73] Assignee: Eastman Kodak Company, Rochester, N.Y.

[21] Appl. No.: 774,717

[22] Filed: Mar. 7, 1977

[51] Int. Cl.[2] ..... G03D 3/10

[52] U.S. Cl. ..... 354/330; 354/329; 354/322; 354/344; 134/79; 134/166 R

[58] Field of Search ..... 354/311, 312, 313, 314, 354/316, 319, 320, 321, 322, 328, 329, 330, 340, 341, 344; 134/78, 79, 142, 166 R

[56] References Cited

U.S. PATENT DOCUMENTS

| | | | |
|---|---|---|---|
| 3,623,416 | 6/1968 | Andberg | 354/330 |
| 3,672,289 | 6/1972 | Kelso | 354/322 |
| 3,882,527 | 5/1975 | Sawada et al. | 354/322 |

*Primary Examiner*—L. T. Hix
*Assistant Examiner*—Alan Mathews
*Attorney, Agent, or Firm*—J. A. Mathews

[57] ABSTRACT

Processing apparatus includes a plurality of processing tanks with a separate film transport and agitating assembly for each tank. Each transport device receives film units, of the type having a plurality of disc-shaped film elements supported in spaced relation on an elongated shaft, and revolves the film units around a central axis, into and out of its processing tank. Each agitating device provides separate drive to rotate the film units on their shaft axes during movement in the tank. Successive transport devices can have different film unit capacities and move the film units at predetermined synchronous rates to facilitate a continuous throughput rate of film units into and out of the apparatus, but allow different processing periods in different processing tanks.

12 Claims, 9 Drawing Figures

ROTARY FILM PROCESSING APPARATUS

BACKGROUND OF THE INVENTION

1. Field of the Invention

The present invention relates to apparatus for processing photographic film and in particular to such apparatus in which batches of discrete, disc-shaped film elements, are moved through a plurality of treating stations and in which continuous throughput is achieved with varying treating times at different stations.

2. Description of the Prior Art

A multitude of devices have been heretofore devised for processing photographic film. Common concerns for processing film in any such device are the desire to minimize mechanical contact with front and back surfaces of the film and the desire to obtain an intimate contact between the film surfaces to be processed and the processing solutions, in proper concentration and without external contaminates or carryover between different processing solutions. A further desire from the economic viewpoint is to provide apparatus which is low in cost and simple in operation, yet capable of high quantity through-put with uniformly high quality results.

Processing apparatus design to a large extent is constrained by the configuration or format of the film elements to be handled and to date most such apparatus have been adapted particularly for strip film. Two common general types of processors for strip film are (1) continuous processors in which the strip is fed by drive and guide rollers through the various processing stations and (2) reel processors in which film strips are wound spirally about reels that are then manipulated into and out of the processing stations. Shorter strips are often spliced to form a longer strip.

Devices for processing film elements of other formats, e.g., chips, or small sheets have not been so common. One popular approach is to support a plurality of film chips to be processed in a rack and sequentially dip the rack into treating reservoirs.

SUMMARY OF THE INVENTION

It is a purpose of the present invention to provide for processing of discrete film elements of a novel format in a manner which achieves the desirable characteristics mentioned above and offers significant advantages in various aspects over prior art devices.

Thus one object of the present invention is to provide improved apparatus and approach for processing photographic film.

Another object of the present invention is to provide improved apparatus for processing small, discrete film elements.

A more specific object is to provide such apparatus which minimizes mechanical contact with important image areas of the film.

Another more specific object is to provide such apparatus which enhances processing fluid contact with important image areas of the film.

Another more specific object is to provide such apparatus which allows continuous throughput of film batches at a constant rate while facilitating varying treatment periods at the various processing stations of the apparatus.

The above and other objects and advantages are achieved in accordance with the present invention by processing apparatus which supports a plurality of disc-like film elements to be developed in spaced relation on a shaft passing generally through the center and normal to the face of the film disc. The image portions of the film element are located in an annular zone spaced slightly from the supporting aperture at the center of the element. When a plurality of the disc elements are arranged on the support, a cylindrical film unit comprising a batch of elements to be developed together is provided.

The processing apparatus comprises a plurality of processing stations each of which includes a liquid reservoir, means for supporting film units in, and transporting film units through the reservoir and means for rotating film units on their shaft axes during passage through the reservoir to enhance contact between film and treating liquid. In accordance with one preferred embodiment of the present invention, the support and transport means are constructed to receive and revolve a plurality of film units about a central axis into and out of the treating fluid and transfer means are provided for moving film units from one transport means to the next. In accordance with another preferred feature, the transport means at various stations can have different film unit capacities and revolution of the film units by the various transport means are timed to provide continuous throughput but different treating periods at different treating stations.

BRIEF DESCRIPTION OF THE DRAWINGS

The invention is hereinafter described in connection with the attached drawings which form a part hereof and in which.

DETAILED DESCRIPTION OF THE PREFERRED EMBODIMENTS

Figure 1:
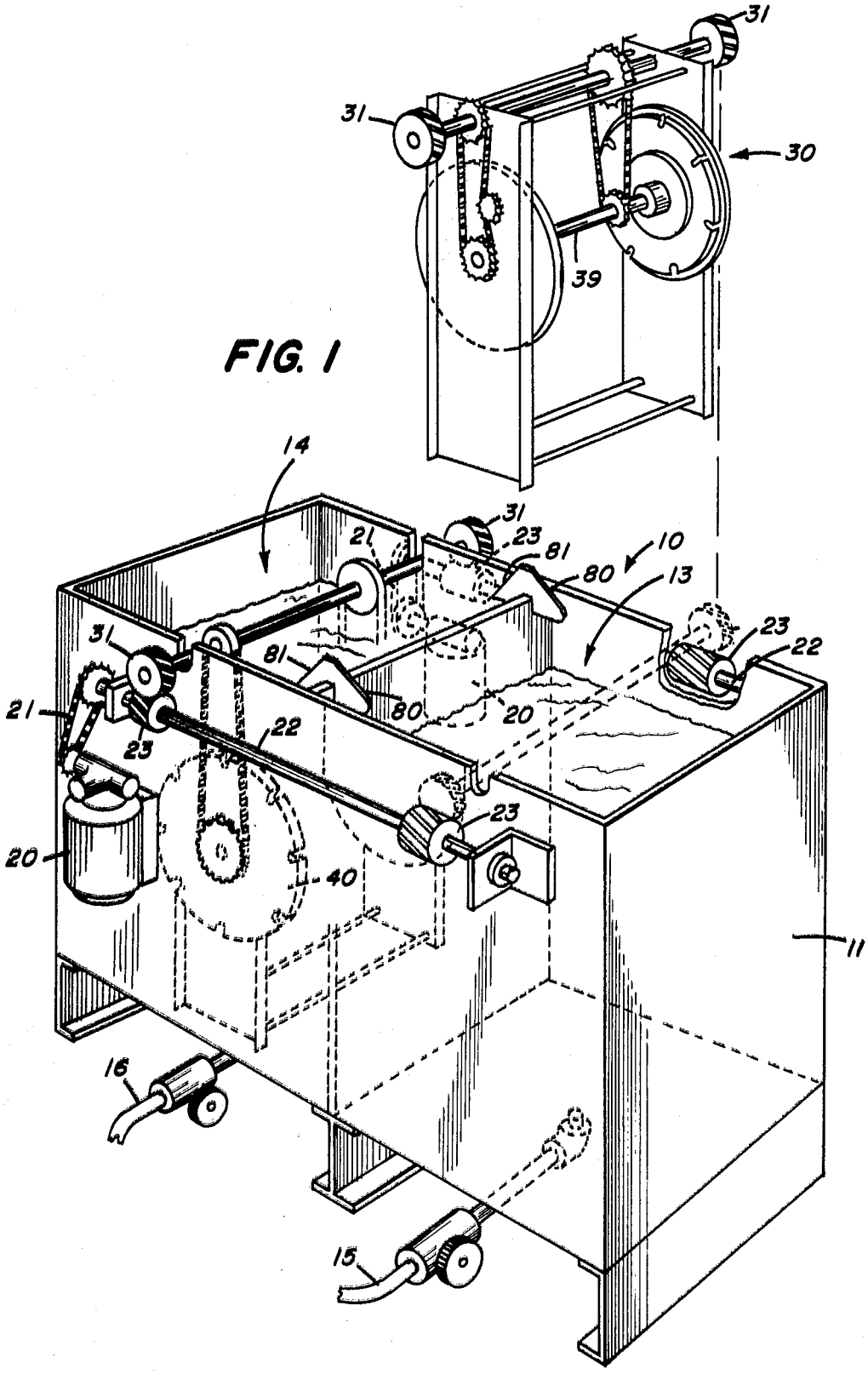
FIG. 1 is a partially exploded perspective view of processing apparatus in accordance with one embodiment of the present invention.

As shown in FIG. 1, a processor 10 in accordance with one embodiment of the present invention comprises a main housing 11 defining a plurality of processing tanks. In this illustrative embodiment only two such tanks 13 and 14 as shown. It will be appreciated that additional such tanks and the assemblies to be described therefore can be provided in series in accordance with the chemistry of the film to be processed. Conduits 15 and 16 are provided to supply and discharge processing liquids to the tanks 13 and 14 respectively.

In the embodiment illustrated two drive and transmission trains are provided, one on each side of the processor. Each drive and transmission train includes a motor 20, which via belt 21 and shaft 22 provides drive output to gears 23 which in turn are couplable to transmit drive to the agitating and transport assemblies 30 via input gears 31 thereof. It will be appreciated that a single motor could be utilized if desired, or that separate motors could be utilized for each assembly 30 by modification of the input drive in a manner apparent to one skilled in the art.

Figure 2:
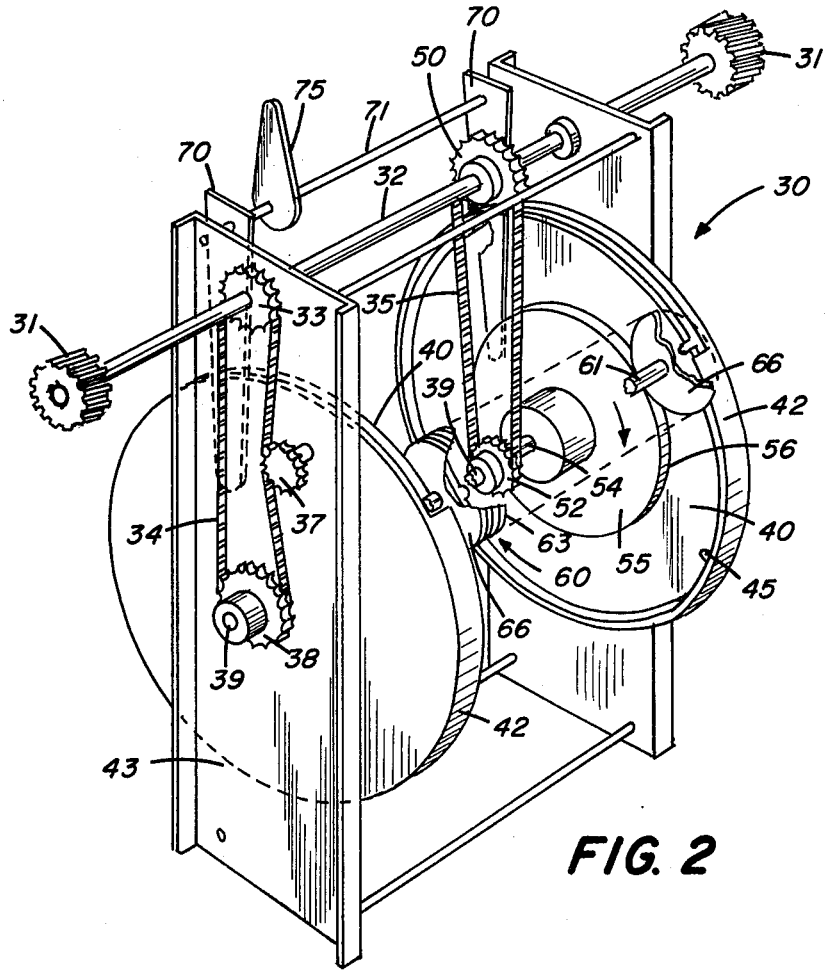
FIG. 2 is an enlarged perspective view of a portion of the processing apparatus shown in FIG. 1.
Figure 3A:
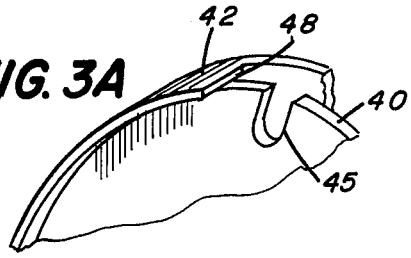
FIGS. 3A and 3B are, respectively, perspective and side views of portions of a transport disc mechanism which forms a part of the apparatus shown in FIG. 1.

Referring now to FIG. 2, it can be seen that drive input to gears 31 commonly rotates main drive shaft 32 to which are geared two drive belts 34 and 35, respectively. The belt 34, via gear 33 and tensioned by gear 37, transmits drive to gear 38 which is keyed to lower drive shaft 39. Also keyed to shaft 39 are film unit transport discs 40 which are concentrically located within disc shells 42 (see FIGS. 3A and 3B). The disc shells are fixedly supported on the assembly frame 43. Thus drive from belt 34 rotates discs 40 at a rate dependent on the rate of input drive and the ratio of gears 33 and 38.

Belt 35 is coupled at one end to shaft 32 by gear 50 and at the other end to gear 52 which is coupled by sleeve 54 to film unit drive disc 55. The gear 52, sleeve 54 and disc 55 are all rotatable on lower shaft 39. It is to be noted that disc 55 has an "O-ring" drive surface 56 and transport disc 40 is provided with four support notches 45 for purposes of handling film units within the processor in a manner which will be described after an explanation of film unit 60.

Figure 4:
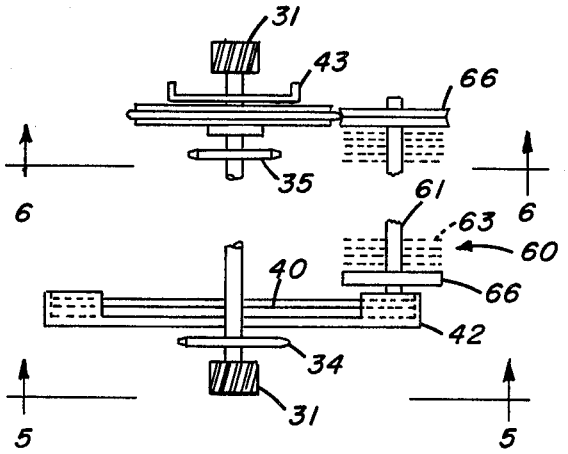
FIG. 4 is a top view of portions of the subassembly shown in FIG. 2.
Figure 6:
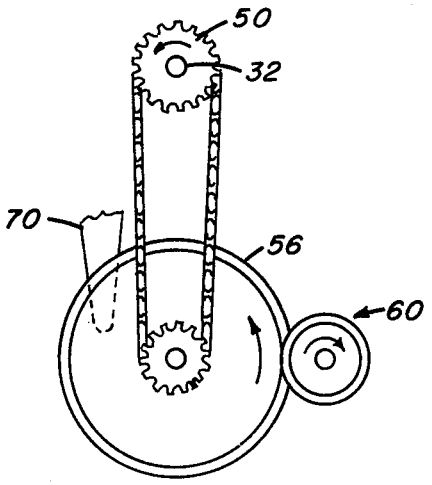
FIG. 6 is a side view of a portion of the subassembly of FIG. 2 taken in the direction 6—6 indicated in FIG. 4.
Figure 5:
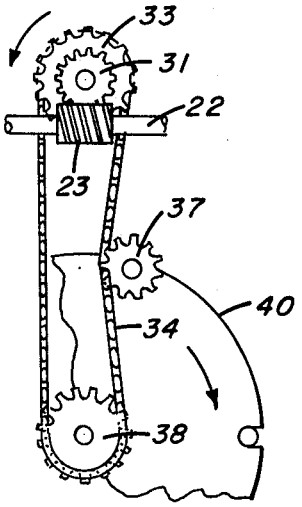
FIG. 5 is a side view of a portion of the subassembly of FIG. 2 taken in the direction 5—5 indicated in FIG. 4.

As best shown in FIGS. 2 and 4, the film unit 60 comprises an elongated shaft 61 on which a plurality of film elements 63 configured as discs are mounted in a spaced relation by a central disc aperture. The unit 60 has disc-shaped end members 66, of slightly larger diameter than the film elements, fixedly connectable to shaft 61.

As shown in FIG. 2, when inserted in the processing apparatus, film unit 60 rests rotatably in notches 45 of transport disc 40. Also it can be seen that the peripheral surface of a film unit end 66 is in driving engagement with surface 56 of drive disc 55.

As will be apparent from the drawings and the foregoing discussion, when motors 20 are energized film units will revolve around shaft 39 by means of drive transmitted to transport discs and at the same time will be rotated on their axis, i.e., shaft 61, by virtue of drive transmitted to drive disc 55. As shown, it is desirable that the ratio of gears 50 to 52 and diameter of disc 55 to film unit end 66 be such that rotation of the film unit on its axis is more rapid than its revolution into and out of the processing tank. This rotation provides enhanced contact between the film elements in the unit and the processing chemicals in the tank.

Figure 3B:
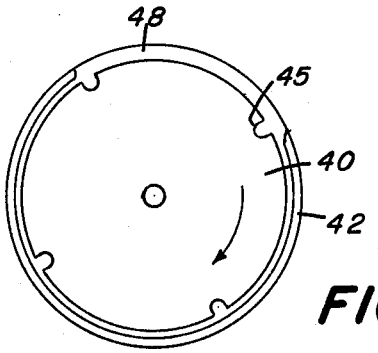
Figure 7:
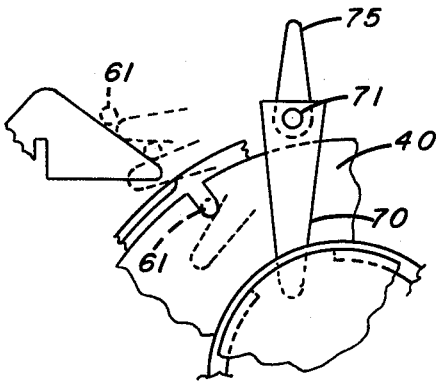
FIGS. 7 and 8 are enlarged side views of portions of the apparatus shown in FIG. 1 illustrating the details of transfer of film between processing stations of the apparatus.
Figure 8:
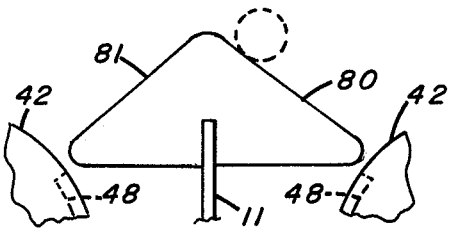

Referring now to FIGS. 1 and 3B, it can be seen that after a film unit is inserted into notches 45 of transport disc 40 in the upper opening 48 of shell 42, it is revolved down into processing tank 13 as described above, while being rotated rapidly for agitated development by disc 55. After making a substantial portion of a revolution about axis 39, the film unit moves upwardly out of the processing solution in the tank 13 and is cammed out of transport disc 40 by transfer levers 70 which are supported on rod 71 as shown in FIG. 2 and actuated by actuator 75, also coupled to rod 71. As indicated in phantom in FIG. 7, a film unit is moved up and over ramp 80, located between tanks 13 and 14 by the levers 70 and thereafter moves down incline 81 and into recesses on the transport disc 40' of the film transport assembly in tank 14.

The film agitating and transport assembly in tank 14 can be identical to that described above with respect to the assembly of tank 13. However, it is sometimes desirable to provide different time periods in different processing solutions. An advantageous way to accommodate this processing requirement and still maintain a continuous throughput of film units is shown in FIG. 1, where discs 40 have 8 pair of film support notches instead of the four pair of disc 40.

Thus, if drive to disc 40' is at one half the rate of disc 40, film units can be retained in solution in tank 14 twice as long as in tank 13 with constant throughput maintained. It will be apparent to one skilled in the art that this concept can be varied to achieve different processing time ratios by other variations of transport disc structure and drive rates.

Although the transport and rotating system is particularly advantageous in connection with a multitank processing device, the system is also useful in connection with a single tank processing apparatus. For example, a single tank unit can be provided with the rotating and transport system herein described and liquids change periodically. Or, several single tank processors could be provided containing different solutions and transfer of film units between processors could be effected manually or by other means than is herein described.

The invention has been described in detail with particular reference to certain preferred embodiments thereof, but it will be understood that variations and modifications can be effected within the spirit and scope of the invention.

What is claimed is:

1. Processing apparatus for processing in photographic processing chemicals a plurality of photographic film elements supported on a common shaft passing through apertures in the central portions of the film elements, said apparatus comprising:

a processing tank for containing photographic processing chemicals, the processing tank having a first side and a second side opposite the first side;

means for supporting the shaft in said processing tank;

means for transporting the supported shaft through the processing tank downwardly from the first side and upwardly toward the second side; and means for rotating the supported film elements during transport of the supported shaft through said processing tank;

whereby the film elements are simultaneously rotated and transported through the processing chemicals from the first side to the second side of said tank.

2. Processing apparatus for processing in photographic processing chemicals a plurality of photographic film discs supported side-by-side on an elongate shaft, the shaft extending normal to the discs through apertures in the central portions of the discs, said apparatus comprising:

a processing tank for containing photographic processing chemicals;

means for supporting the shaft horizontally in said processing tank and for rotating the horizontally supported shaft in said processing tank to rotate the film discs in the processing chemicals; and means for transporting the horizontally supported rotating shaft through the tank in a direction normal to the shaft to transport the rotating film discs through the chemicals.

3. Processing apparatus for processing in a photographic processing solution a plurality of individual photographic film elements supported together on a common elongate shaft extending through centrally located apertures in the film elements; said apparatus comprising:

a tank for containing processing solution;

means cooperating with the shaft for transporting the film elements through said tank in contact with the processing solution downwardly along one path and then upwardly along another path within said tank; and means for rotating the film elements about the longitudinal axis of the shaft during transport of the film elements along the one and another paths to augment contact between the film elements and the processing solution.

4. Photographic processing apparatus for processing a plurality of film elements supported on a common shaft defining a longitudinal axis and extending through centrally located apertures in the film elements; said apparatus comprising:

a processing tank;

means for supporting the shaft within the tank, and for rotating the film elements on the longitudinal axis of the shaft; and means for transporting the supported shaft and rotating film elements through the tank downwardly and then upwardly around a second axis spaced from and parallel to the longitudinal axis of the supported shaft.

5. Apparatus for processing film units of the type including a plurality of disc-shaped film elements supported on an elongate shaft extending through central portions of the film elements and having a longitudinal axis, said apparatus comprising:

a processing tank;

transport means for receiving and supporting the elongate shaft and for revolving a received unit downwardly and then upwardly around a horizontal axis in the processing tank external to the film unit; and drive means for rotating the received film unit about the longitudinal axis of the shaft during movement of the received film unit around the horizontal axis.

6. Apparatus as claimed in claim 5 wherein said transport means includes a pair of spaced transport disc members rotatable on said horizontal axis and having a plurality of film unit retaining means spaced equidistantly around the periphery of the disc members.

7. The invention defined in claim 6 wherein the film unit includes disc-shaped end members attached to the shaft and said drive means includes a drive disc coaxial with, but independently rotatable with respect to, said transport discs, said drive disc being dimensioned to engage an end member of a film unit supported by said transport discs.

8. Apparatus for processing in processing solutions a plurality of photographic film elements supported by a shaft having a longitudinal axis and extending through the central portions of the film elements, said apparatus comprising:

a plurality of tanks for processing solutions, the tanks arranged in seriatum one adjacent another, each tank having a first side and a second side opposite the first side;

means engageable with the shaft for transferring the shaft and thereby the film elements from the second side of one tank to the first side of an adjacent tank;

means within said adjacent tank for receiving the shaft from said transferring means and for transporting the shaft downwardly from the first side and then upwardly toward the second side within said adjacent tank to immerse the film elements in the processing solution in said adjacent tank, said receiving and transporting means supporting the shaft horizontally within said tank; and means for rotating the film elements about the longitudinal axis while the shaft is transported within the tank and the film elements are immersed in the processing solution.

9. Processing apparatus for processing film units of the type including a plurality of flat disc-shaped elements supported on an elongated shaft with face surfaces of the elements normal with respect to the longitudinal axis of the shaft, said processing apparatus comprising:

a plurality of processing tanks located sequentially along a processing path;

a plurality of film unit transport and agitating assemblies located in said tanks respectively, each such assembly including:

transport means for receiving and rotatably supporting a film unit shaft and for revolving a received unit around a horizontal axis externally of the film unit into and out of the tank in which the transport means is located; and drive means for rotating the film unit supported by said transport means about the longitudinal axis of the shaft during revolvement of the supported film unit by said transport means; and means for transferring film units from one assembly to the next sequential assembly along the processing path.

10. Processing apparatus as claimed in claim 9 wherein each of said transport means receives and revolves a plurality of such film units simultaneously and wherein one of said transport means receives more film units and revolves at a slower rate than another of said transport means to provide continuous film unit throughput with different processing periods in the different tanks.

11. Processing apparatus according to claim 9 wherein said transport means includes a pair of spaced transport discs rotatable on said external axis and having a plurality of film unit retaining means spaced equidistantly around the periphery of the discs.

12. Processing apparatus according to claim 11 wherein the film units include end members attached to their shafts, and said drive means includes a drive disc coaxial with, but independently rotatable with respect to, said transport discs, said drive disc being dimensioned to engage an end member of a film unit supported by said transport discs.

* * * * *